United States Patent [19]

Yagasaki et al.

[11] Patent Number: 4,582,417

[45] Date of Patent: Apr. 15, 1986

[54] APPARATUS FOR FORMING IMAGES

[75] Inventors: Toshiaki Yagasaki, Hino; Shunichi Masuda; Yukio Sato, both of Tokyo, all of Japan

[73] Assignee: Canon Kabushiki Kaisha, Tokyo, Japan

[21] Appl. No.: 396,462

[22] Filed: Jul. 8, 1982

[30] Foreign Application Priority Data

Jul. 13, 1981 [JP] Japan ..... 56-109088

[51] Int. Cl.[4] ..... G03G 15/00

[52] U.S. Cl. ..... 355/7; 355/14 R; 355/14 E

[58] Field of Search ..... 355/7, 14 R, 14 E, 71, 355/1

[56] References Cited

U.S. PATENT DOCUMENTS

| | | | |
|---|---|---|---|
| 4,215,929 | 8/1980 | Sato et al. | 355/7 |
| 4,255,042 | 3/1981 | Armitage, Jr. et al. | 355/1 X |
| 4,256,400 | 3/1981 | Komori et al. | 355/71 X |
| 4,354,757 | 10/1982 | Ritzerfeld | 355/7 |

*Primary Examiner*—A. T. Grimley
*Assistant Examiner*—J. Pendergrass
*Attorney, Agent, or Firm*—Fitzpatrick, Cella, Harper & Scinto

[57] ABSTRACT

An image-forming apparatus is disclosed which is able to form an image while blanking any unnecessary image portion or extracting any desired image portion at one's will. To this end, the apparatus includes a plurality of light exposing means, an image area setting means and control means. Said control means selectively renders said individual light exposing means operative or inoperative according to the selected image area by said image area setting means.

8 Claims, 13 Drawing Figures

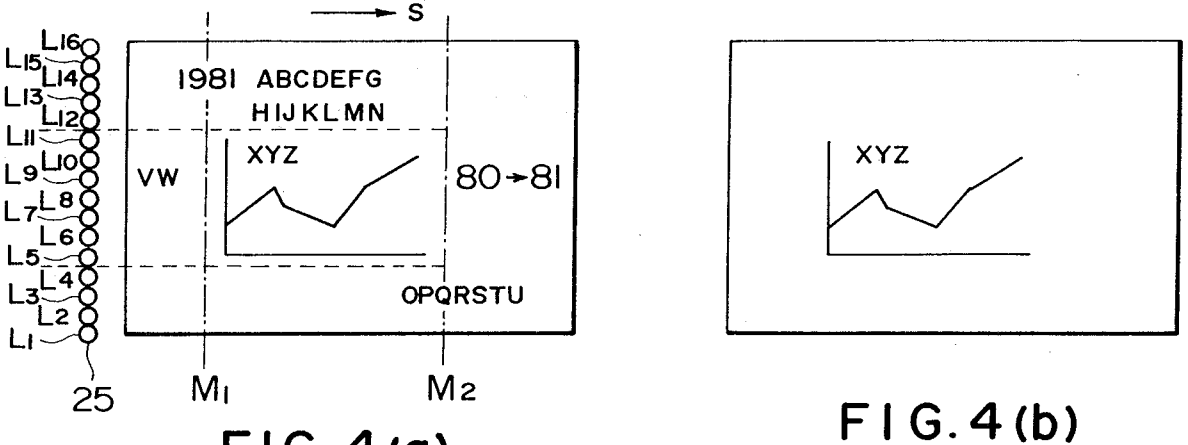
FIG. 4(a)
FIG. 4(b)
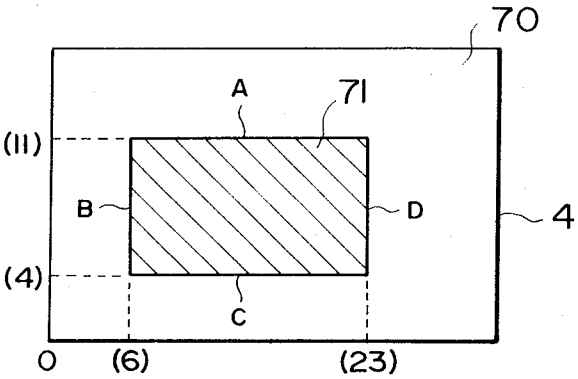
FIG. 5

APPARATUS FOR FORMING IMAGES

BACKGROUND OF THE INVENTION

1. Field of the Invention

The present invention relates to an image-forming apparatus such as a copying machine which is able to form an image while blanking any unnecessary image portion or extracting any desired image portion.

2. Description of the Prior Art

In the technical field of image-forming apparatus such as an electrophotographic copying machine it is known to form a blank portion in a selected end area of an image for obtaining a binding margin. According to the conventional technique the formation of such a blank portion is attained by shifting the image relative to the transfer paper or omitting a portion of the image over a determined width. This is relatively easy to carry out. However, if it is wished to extract an image portion from an original image or to blank out some unnecessary portions from the original image, the required process is difficult to carry out with the known copying machine. In such a case, it is required to carry out the copy making operation while keeping the unnecessary portions of the original covered with a white paper or it is required to cut out the desired portion from the original and then to attached the extracted portion to a separate white paper. The copying operation can be started only after the extracted portion has been attached to the white paper. This procedure is troublesome for the user of the copying machine very much. Further, it is very time-consuming.

SUMMARY OF THE INVENTION

Accordingly it is an object of the present invention to provide an image-forming apparatus which enables the user to extract any desired image portion or to blank out any unnecessary image portion at will, without any troublesome work.

It is another object of the invention to provide an image-forming apparatus with which the user is allowed to set the image area to be extracted or to be blanked.

It is a further object of the invention to provide an image-forming apparatus which is provided with a plurality of light exposing means arranged in a row intersecting the moving direction of a photosensitive medium on which a latent image is to be formed and in which apparatus said individual light exposing means can be driven selectively so as to blank out the selected image portion only.

It is still a further object of the invention to provide an image-forming apparatus in which the electric charge at least on the side end portion along the moving direction of the photosensitive medium can be removed over any desired width.

Other and further objects, features and advantages of the invention will appear more fully from the following description.

BRIEF DESCRIPTION OF THE DRAWINGS

FIGS. 4(*a*) and 4(*b*) illustrate the principle of image extraction;

FIG. 5 illustrates how to give the instruction of the image area to be cancelled;

FIGS. 7-1 composed of FIG. 7-1A and FIGS. 7-1B and 7-2 composed of FIG. 7-2A and FIG. 7-2B are flow charts showing a control program.

DETAILED DESCRIPTION OF PREFERRED EMBODIMENTS

Figure 1:
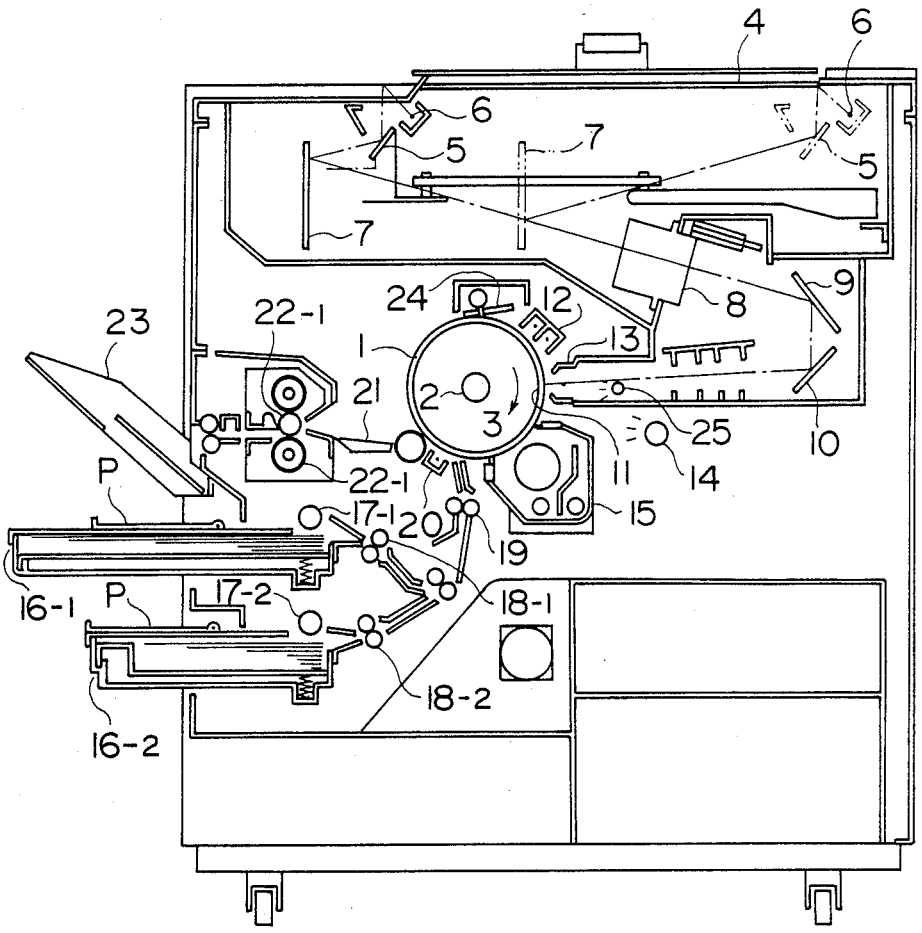
FIG. 1 is a sectional view of a copying apparatus in which the present invention is embodied.

Referring first to FIG. 1 there is shown a copying machine in which the present invention has been embodied.

Designated by 1 is a photosensitive drum of known three-layer structure as formed, for example, using CdS as a photoconductive material. The drum 1 is mounted on a shaft 2. When a copy instruction is introduced in the machine, the drum 1 starts to rotate in the direction of arrow 3. Element 4 is an original table glass on which an original is placed with its image side downward. With a predetermined rotation of the drum 1, the original is illuminated by an illumination lamp 6 integral with a first scanning mirror 5. The light reflected from the original is directed to a lens 8 through the first scanning mirror 5 and a second scanning mirror 7. The first and second scanning mirrors 5 and 7 move in the speed ratio of 1:½ so that the optical path length up to the lens 8 can be kept constant during the scanning of the original.

The reflected light forms an image on the drum 1 at the exposure part 11 through the lens 8 and a third mirror 9 and then through a fourth mirror 10.

The drum 1 is precharged by a primary charger 12 (for example, with the positive polarity) and then slitwise exposed to the light image by the illumination lamp 6 at the exposure part 11. Simultaneously with the imagewise exposure, the drum surface is subjected to the action of alternate current or of discharge by a discharger 13 with the opposite polarity (for example, negative) to that of the primary charge. Thereafter, the whole surface of the drum 1 is exposed to light by a whole surface exposing lamp 14 so as to form a high contrast electrostatic latent image on the photosensitive drum 1. The electrostatic latent image thus formed on the drum is then developed to a toner image by a developing device 15.

A transfer paper P is fed into the machine from a paper cassette 16-1 or 16-2 through a paper feeding roller 17-1 or 17-2. In feeding the transfer paper P, a first registering roller 18-1 or 18-2 roughly adjusts the timing of paper feed and a second registering roller 19 precisely adjusts the timing to register the transfer sheet P with the toner image on the drum 1.

The transfer paper P is advanced to the drum in good timing in this manner and it enters the area between the drum 1 and a transfer charger 20 where the toner image is transferred onto the transfer paper from the drum surface. After transferring, the transfer paper P is guided to a conveyor belt 21 by which the transfer paper P is further moved to the fixing station. At the fixing station, the toner image on the transfer paper P is fixed by a pair of fixing rollers 22-1 under the action of pressure and heat. After fixing, the transfer paper is discharged into a tray 23.

On the other hand, after transferring, the drum 1 enters the cleaning station where the drum surface is cleaned up by a cleaning device 24 composed of an elastic blade. Thus, the photosensitive drum gets in the state prepared for the next cycle of operation.

Designated by 25 is a blank lamp unit comprising a plural number of lamps. The lamps are arranged in a row intersecting the direction in which the photosensitive surface is moved with the rotation of the drum 1. To remove the primary charge on the photosensitive drum 1, selectively the blank lamp unit can be turned on simultaneously with the operation of the discharger 13. When a selected portion of the drum 1 is illuminated by the blank lamp unit 25, the charge previously applied by the primary charger 12 is removed from the drum 1 at the selected portion. Therefore, no toner is attracted to the portion and there forms a blanked portion on the drum.

Although discharge by the discharger 13 is required simultaneously with the irradiation by the blank lamp unit 25 to remove the charge in this embodiment utilizing a three-layer photosensitive medium employing CdS photoconductive material, it is to be understood that in the case of the so-called Carlson's process, such discharge by the discharger 13 is unnecessary and the charge on the drum can be removed as desired by the irradiation of the blank lamp unit 25 only.

Figure 2:
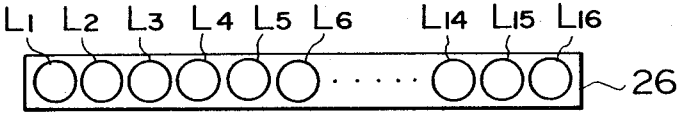
FIG. 2 is a schematic view of the blank lamp 25 in the apparatus.

FIG. 2 schematically shows the structure of the blank lamp unit 25.

The unit 25 has a frame 26 the length of which is substantially equal to the width of the photosensitive drum 1. In the frame 26 there are sixteen lamps L1 to L16 arranged in an array. Each of the lamps may be a light emitting diode or a midget lamp. These sixteen lamps L1 to L16 can be turned On and Off independently of each other. The sectional areas on the drum surface to be illuminated by the respective lamps are predetermined so that the charge on the drum 1 can be removed from any desired area or areas by turning on the corresponding lamp or lamps selectively.

Figure 3:
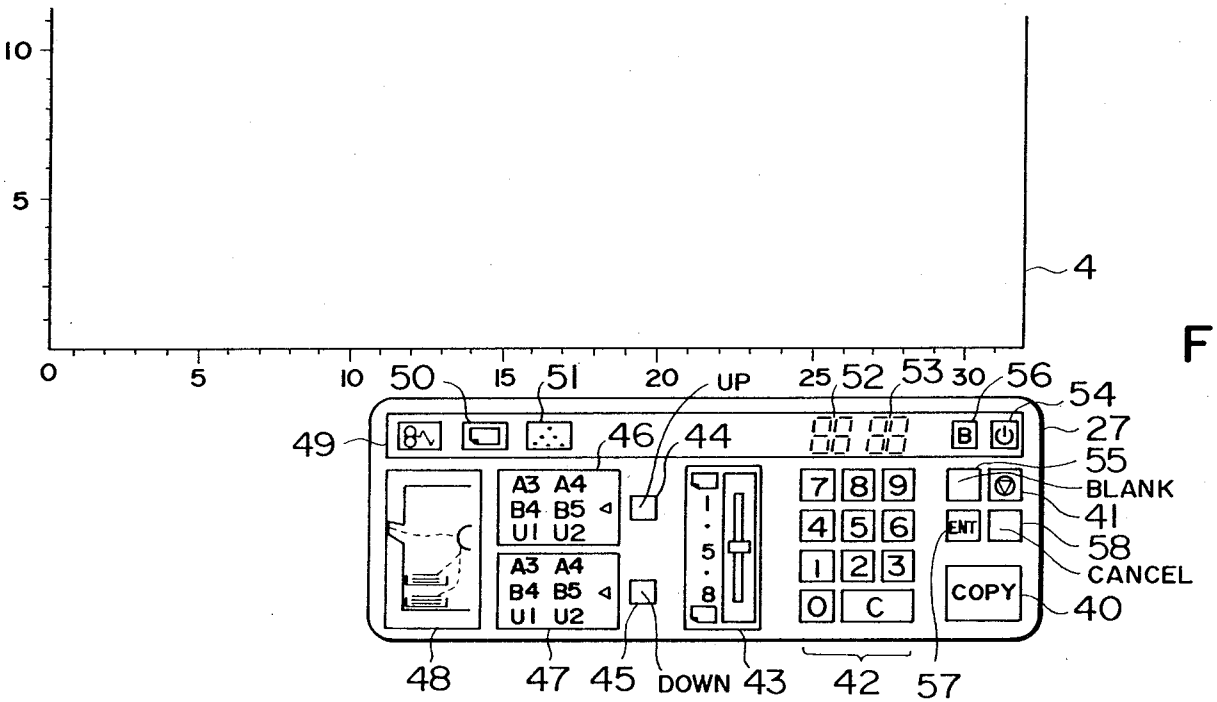
FIG. 3 is a view showing the arrangement of the operation board and the original table glass in the apparatus.

FIG. 3 is a detailed view of the operation board 27 and the original table glass 4 on the top surface of the copying machine. Disposed on the operation board 27 are various keys and display devices of which 40 is a copy key for giving the instruction to start a copying operation. 41 is a stop key for stopping the copying operation. Keys generally designated by 42 are numeral keys (ten keys) used to set the desired number of copies to be made and to set the image area to be blanked. "C" key is a clear key for clearing out the value set by the numeral keys.

Element 43 is a density setting lever by which the density of copy image can be set as desired within the range of grade 1 to grade 9 along the scale. The grade 1 is the thickest and the grade 9 is the thinnest.

Element 44 is a cassette selection button for selecting the upper cassette and shown also is a cassette selection button 45 for selecting the lower cassette. Elements 46 and 47 are cassette size display devices for displaying the sizes of transfer papers contained in the respective cassettes preset in the machine body. Numeral 48 designates a display device for displaying the location of occurring jam, while numeral 49 is a jam indicator which lights up when any transfer paper gets jammed in the machine. Element 50 is a paper/cassette supply indicator which lights up when the cassette has not yet been set in the machine or when all of the transfer sheets in the cassette have been used up. Element 51 is a toner supply indicator which lights up when the developing device 15 is short of toner. Element 52 is a set copy number display device for displaying the desired number of copies set by the numeral key 42. It normally displays "1". Indicator 53 is a copy number display unit for displaying the number of copied sheets with an increment of "1" per copy starting from "0". Light 54 is a wait indicator which continues to be ON during the period from the throw-in of the power source to the time point at which the temperature of the fixing device reaches a level sufficient to perform fixing. So long as the indicators 49, 50 and 54 are lighting up, no copying operation can be started even when the operator pushes on the copy key 40.

Element 55 is a blank key which is keyed on when the operator wishes to blank off any portion of the original image for the purpose described above. When the blank key is pushed on, the copying machine is changed over to the blank mode in which the machine is able to blank out the selected image portion. In this mode, the input values from the numeral keys 42 are used to set the image blanking area. Also, in this mode, the copy number display device 52 performs another function, that is, to display in flicker the input values from the numeral key 42 during the setting of the image blanking area. Element 56 is a blank indicator for indicating that the blank key 55 has been keyed on and the apparatus is now in the blank mode. The blank mode can be cancelled by a blank mode cancel key 58. If the copying operation in the blank mode is not effected for any reason within a determined time from the key-on of the blank key 55, the blank mode once set is automatically cancelled even when the blank cancel key 58 is not pushed. Element 57 is an entry key for making an entry of the input numerical data by the numeral keys 42 into the machine as setting values for the image blanking area.

The original table glass 4 can accommodate itself to the original of A3 format (210 mm×297 mm) at the maximum. Reference blank scale marks are provided along the right-hand side edge and the lower side edge as viewed in FIG. 3. The scale on the right-hand side edge has graduations, 0 to 16 and that on the lower side edge has 0 to 32 at equal distances.

The principle of image extraction according to the invention will be elucidated hereinafter with reference to FIG. 4.

FIG. 4(*a*) shows an example of an original of A3 format containing a graph and a description thereof. By way of example, let us consider the case where it is wished to obtain a copy of the original while extracting only the graph portion from the original as shown in FIG. 4(*b*). Arrow S indicates the scaning direction in which the original is slitwise exposed. Element 25 is a blank lamp unit corresponding to the original.

During the slitwise exposure from the left-hand edge to the line M1 of the original (a), all of the sixteen blank lamps are ON. During the slitwise exposure from M1 to M2, only nine lamps, L1 to L4 and L12 to L16 are ON. Lamps L5 to L11 are Off during that time. From M2 to the right-hand edge of the original, all of the sixteen lamps are again ON. Therefore, the latent image formed on the drum 1 corresponds to only such image portion which lies between M1 and M2 and in the sectional areas corresponding to the blank lamps L5 to L11.

In this manner, the unnecessary image portion is blanked off by selectively turning ON those blank lamps corresponding to the unnecessary image areas simultaneously with the slitwise exposure.

The timings for the selective ON-OFF of the blank lamps are preset by the user by use of the numeral keys 42 on the operation board shown in FIG. 3. For the input of ON-OFF timing of the sixteen blank lamps, the above described reference scales provided on the original table glass (FIG. 3) are used in the manner later described.

FIG. 5 illustrates the manner of the input of data for an image blanking area.

In FIG. 5, the reference numeral 4 depicts the original table glass. Numeral 70 designates an original on the table glass 4. The hatched area 71 is the image area to be extracted from the original. A, B, C and D are four sides of the extracted image area 71.

After placing the original 70 on the original table glass 4, the operator extends the four sides A, B, C, D toward the reference blank scales and reads the marked values on the scales at the intersections of the extended lines and the scales. Then, the operator makes inputs of the numbers indicated by the scales. If the line extension does not just meet a scale mark, then a number as indicated by the closest mark to the line extension is employed for the input of numerical data. In the shown example in FIG. 5, the side A of the extracted image area 71 is at 11 on the scale, side B is at 6, side C is at 4 and side D is at 23. These four values are introduced into a control part as described later (micro computer 60) by use of the ten keys 42. The control part controls ON-OFF of the above blank lamps L1 to L16 according to the input data. By the input of four suitable values in a manner similar to the above it is also possible to blank out only the image portion of a narrow strip area at one side of the original along or across the moving direction of the drum 1.

Figure 6:
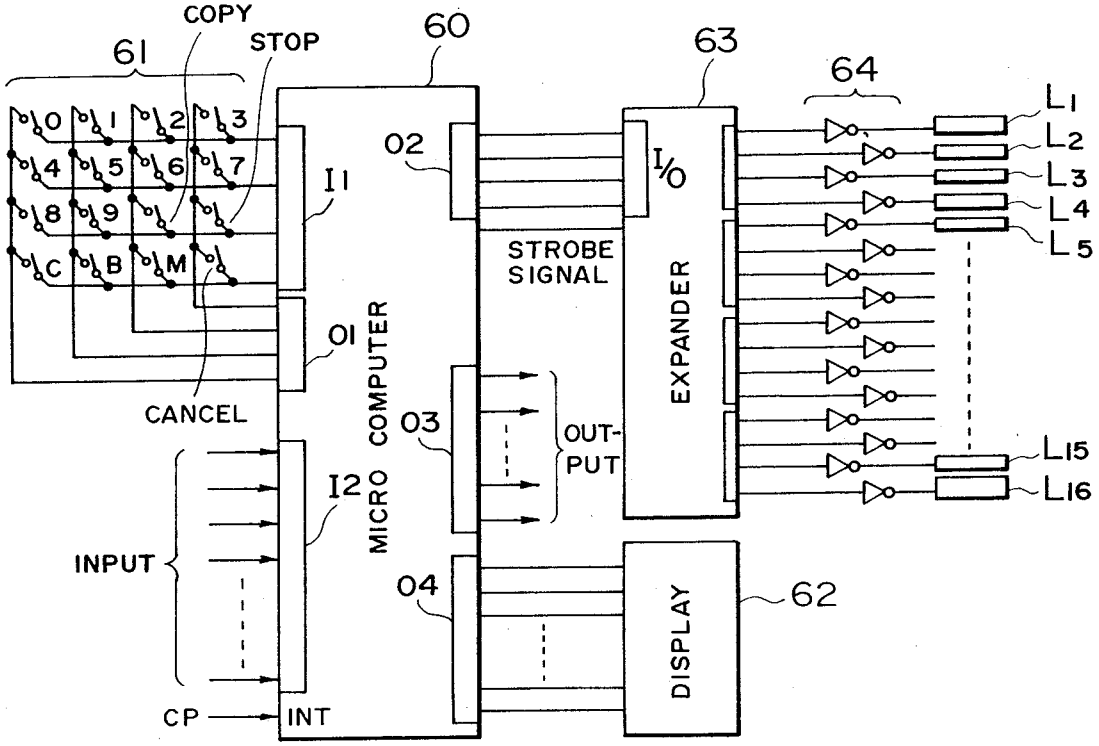
FIG. 6 is a block diagram showing an embodiment of the control circuit used in the invention.

FIG. 6 shows an embodiment of the control circuit used in the invention.

In FIG. 6, the reference numeral 60 depicts a known one-chip micro computer. INT is an interruption terminal. A determined pulse signal CP is applied to the interruption terminal from a known pulse generator. The applied pulse signal CP serves as operation reference for the micro computer 60. 61 are keys on the operation board shown in FIG. 3. The micro computer 60 discriminates the state of every key 61 by reading the time-divided repeating pulse from an output port O1 into an input port I1. I2 is another input port for receiving various signals from sensors and the like provided in the individual parts of the apparatus. Element 62 depicts various display devices on the operation board shown in FIG. 3. These displays are controlled by the signals from an output port O4 of the micro computer 60. Element O3 is also an output port for output of operation instructions to the individual parts of the apparatus. Element 63 is an I/O expander which controls the sixteen output lines by means of 4-bit binary signals from an output port O2 of the micro computer 60 so that ON-OFF of the sixteen blank lamps L1 to L16 are controlled by the outputs of I/O expander 63 through inverters 64 respectively. More particularly, each of the blank lamps receive from I/O expander 63 an output which is "1" or "0". The output of "1" renders the blank lamp Off and "0" renders it On.

Figures 1, 7:
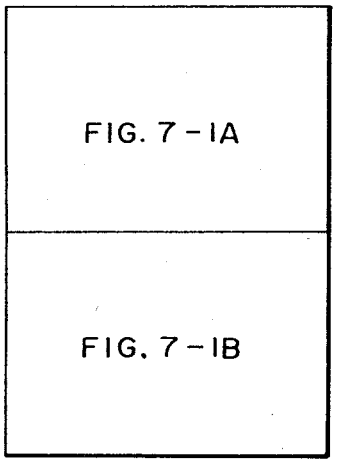

The micro computer 60 shown in FIG. 6 has a control program previously stored in its read-only memory (ROM). FIGS. 7-1 and 7-2 are a flow chart of the control program. Hereinafter, the present invention will be further described with reference to the flow chart.

Following the power-on of the apparatus, there is executed at the first step, S1 an initialization of the apparatus including resettings of RAM within the micro computer 60, I/O expander 63 etc.

At step S2, an inquiry is made as to whether the blank mode has been set by the blank key 55 on the operation board 27 shown in FIG. 3. Also, an inquiry is made as to whether the copy key 40 is ON or OFF. In the case where the blank key 57 has been keyed on prior to the key-on of the copy key 40, the flow of sequence is directed to step S4 at which the apparatus is brought into blank mode to execute the routine for setting an image blanking area. When the blank key 57 is not keyed on but the copy key 40 is keyed on alone, the operation is advanced to step S3 from S2.

At S3, a copying operation is performed in accordance with the normal copy sequence. The copy making operation continues until a desired and preset number of copies are obtained. After completing the copy making operation up to the desired number of copies, the apparatus is returned back again to step S1. At S2, it waits for the next instruction from the blank key 57 and the copy key 40. During the original scanning according to the above normal copy sequence, all of the blank lamps remain OFF.

When the blank mode is set, the blank indicator 56 is lighted on and at step S4 the apparatus waits for the input of numerical data from the ten keys 42. In this mode, the copy number display device 52 can perform the function to display the numerical data for setting a desired blank area. Thus, when a numerical value i is put in by the operator, the display device 52 displays it in flicker. After confirming the input numerical value on the display, the operator operates the entry key 58 to advance the step to S5. In the case of FIG. 5 example, the numerical value i is "4". By the input of this numerical data, the side C of the image extraction area is determined. As a sub-routine, SUB ENTRY, this step S4 can be called for at any other step.

At step S5, the sectional areas corresponding to values less than the input numerical value i introduced at the previous step S4 are set to "0" in the blank-off memory area allocated in RAM of the micro computer 60. More particularly, the sections 1 to i of the blank-off memory area are all set to "0".

At step S6, the sub-routine SUB ENTRY is called for to wait for the input of other necessary numerical data. Similarly to the above step S4, the operator makes an entry of the next numerical value j to determine the side A of the image extraction area 71. In the shown example of FIG. 5, the value j introduced at step S6 is "11". Subsequent to the entry of the value j, the next step S7 is executed.

At S7, "0" is set for the blank-off memory area at the sections corresponding to values larger than the input value j, namely the sections corresponding to j to 16. As a result of the above entry at the steps S4 and S6, the blank-off memory area has now "0" at memory areas from 0 to i and from j to 16 (in the shown example of FIG. 5, they are 0 to 4 and 12 to 16), and "1" at memory areas from $(i+1)$ to $(j-1)$.

At step S8, the sub-routine SUB ENTRY is again called for to wait the next entry of further necessary numerical data like the step S4. The operator puts in the numerical value m to determine the side B of the image extraction area 71 at this step S8. In the shown example of FIG. 5, the input value m at this step is "6". On the completion of the entry of the value m, the next step S9 is executed.

At S9, the value m is multiplied by a determined value t and the product is set to RAM of the micro computer 60 as a first timer value T1. The above value t is a value determined by dividing into 32 the time required for an original of A3-format to be scanned by the optical system. Therefore, the first timer value T1 means the time which the optical system takes to reach the side B of the image extraction area 71 from the start of scanning.

At step 10, the sub-routine SUB ENTRY is again called for to make an entry of the value n to determine the side D of the image extraction area 71. In the shown example, the input value n is "23". After completing the entry of the input value n, the next step S11 is executed.

At the step S11, the value n is multiplied by the above mentioned value t and the product is set to RAM of the micro computer 60 as a second timer value T2. As will be readily understood, the second timer value T2 means the time which the optical system takes to reach the side D of the image extraction area 71 from the start of scanning. Consequently, the micro computer 60 now has data of the first and second timer times T1 and T2 set to its RAM. T1 is data for determining the timing of turn-OFF of the blank lamps and T2 is that for determining the timing of turn-ON of the lamps.

At step S12, the state of the copy key 40 is discriminated as to whether it is ON or OFF. When it is ON, the next step S13 is executed.

At S13, a pre-rotation of the photosensitive drum 1 is carried out to remove any residual electric charge from the drum surface and clean up it. After the pre-rotation, the operation is advanced to the next step S14.

At S14, an exposure starts and the original is exposed through the optical system. Also, time counting of the first and second timer times T1 and T2 starts. At the start of exposure, the outputs of I/O expander 63 are all "0" and therefore the sixteen blank lamps are all ON excepting the case wherein the first timer time T1 is 0.

At step S15, when the time counting of the first timer time T1 is completed, strobe signals are applied to I/O expander 63 and signals of "1" or "0" previously set to the blank-off memory area are put out from the I/O expander 63. Therefore, at this time point, those blank lamps for which "1" has been set in the blank-off memory area, are turned OFF. In the case of FIG. 5 example, the blank lamps L5 to L11 are turned OFF at this time point at which the scanning by the optical system has just reached the side D of the image extraction area.

At step S16, the output of strobe signals are terminated when the counting of the second timer time T2 is completed. Thereby, all of the outputs of I/O expander 63 are rendered again "0" and therefore all of the blank lamps L1 to L16 are ON. In the case of FIG. 5 example, all of the blank lamps become light again at this time when the scanning of the original by the optical system has just reached the side D of the extraction area 71.

At step S17, it is examined whether or not one cycle of copy sequence for image formation is completed. When completed, the step is advanced to S18.

At step S18, it is checked whether the copy making of the desired and preset number of sheets is completed. If not, the operation is returned back again to Step S4 to start the original scanning again.

After completing the copy making, a post-rotation of the photosensitive drum 1 is carried out for cleaning of the drum at step S19. The completion of the post-rotation is detected at the next step S20 and the operation is advanced to S21.

At step S21, counting of a third timer time T3 is started. The third timer time T3 is a predetermined time for cancelling the blank mode. From T3 it is judged whether a further copying operation in the blank mode is to be carried out within the determined time period from the completion of the above copying operation. Whether the counting of the third timer time T3 is completed or not is checked at step S22. When it is completed, the control sequence is advanced to Ⓐ where the initialization is carried out and the blank mode is cancelled at the step S1 and then the apparatus waits for the next key-on of blank key 57 and copy key 40 at step S2.

If the blank cancel key 58 is keyed on prior to the completion of the counting of the third timer time T3, the sequence is advanced to Ⓐ through step S23. Similarly to the above, the initialization is carried out at S1 and the apparatus waits for the next key-on of copy 40 or blank key 55 by the operator at S2.

If the blank key 55 is keyed on again prior to the completion of the counting of the third timer time T3 at step 24, that is to say, if there is made an input of the operator's desire to make copies in the blank mode with a change of the image blanking area, then the initialization is carried out at step 25, and the sequence takes the course of Ⓑ where a desired image blanking area is again set in the same manner as the above.

If the copy key 40 is keyed on prior to the completion of the counting of the third timer time T3 (Step S26), then the sequence ② repeated from Step S13 to restart the copy making operation in the previously set blank mode.

As readily understood from the foregoing, the present invention enables to blank out any unnecessary image portion or extract any desired image portion at the user's will without need of troublesome and time-consuming works.

While the invention has been particularly shown and described with reference to preferred embodiments thereof, obviously various changes and modifications are possible in light of the above teachings. For example, the selective removal of electric charge from the surface of the photosensitive medium may be attained by other means than the particularly shown blank lamp unit. The same effect as attained by the blank lamp unit in the above embodiment may be obtained also by providing a particular light source, charger etc. for the charge removal only in any suitable position.

Means for the input of data of the unnecessary image area is never limited to the ten keys only. Cursor and other position appointing members may be used for the same purpose.

Also, it is to be understood that the application of the present invention is never limited to copying machines only. The present invention may be applied also to other image forming apparatus such as a laser printer in which the photosensitive medium is scanned with a laser beam and a printer employing a photo diode array.

Furthermore, the number of the blank lamps may be increased more than sixteen. By increasing the number of the lamps for removing the electric charge, it is made possible to select more finely divided sectional areas for blanking.

We claim:

1. An image forming apparatus comprising:

a photosensitive medium;

charging means for applying electric charge uniformly on said photosensitive medium;

means for forming a latent image corresponding to an original image on the charged photosensitive medium;

a plural number of light exposing members each for irradiating a respective determined section of said photosensitive medium;

means for setting a desired image area of said original image, wherein said setting means includes key input means for entering area data related to the desired image area and means for storing said area data, and wherein said key input means is also adapted to set the number of times a said visible image is to be formed on recording sheets;

control means for rendering said plural number of light exposing members operative or inoperative independently of each other in accordance with said area data stored in said storing means so as to blank out any unnecessary image portion or extract any desired image portion; and means for recording a visible image on a recording sheet based on the latent image formed on said photosensitive medium.

2. An image forming apparatus as set forth in claim 1, wherein the electric charge at least one the side part of said photosensitive medium along a moving direction thereof is removed over an optionally selected width by rendering said plural number of light exposing members operative or inoperative.

3. An image forming apparatus as set forth in claim 1, wherein said key input means is adapted to enter numerical data.

4. An image forming apparatus as set forth in claim 1, further comprising timer means for controlling the ON-OFF timing of said plural number of light exposing means to blank out or extract any selected image portion in accordance with the image area set by said setting means.

5. An image forming apparatus as set forth in claim 4, wherein said timer means controls ON-OFF functioning of at least one of said plural number of light exposing members.

6. An image forming apparatus as set forth in claim 4, wherein said timer means controls said plural number of light exposing members in such manner as to blank off the image portions before and after the image to be extracted.

7. An image forming apparatus as set forth in claim 1, wherein said plural number of light exposing members are arranged in the direction intersecting a moving direction of said photosensitive medium.

8. An image forming apparatus as set forth in claim 1, further comprising means for exposing an original, wherein said latent image forming means forms the latent image by light reflected from said original.

* * * * *

UNITED STATES PATENT AND TRADEMARK OFFICE

CERTIFICATE OF CORRECTION

PATENT NO. : 4,582,417

DATED : April 15, 1986

INVENTOR(S) : TOSHIAKI YAGASAKI, ET AL.

It is certified that error appears in the above-identified patent and that said Letters Patent is hereby corrected as shown below:

COLUMN 1

Line 27, "attached" should be --attach--.
Line 31, "machine very much." should be --machine.--.

COLUMN 2

Figures 1B, 7:
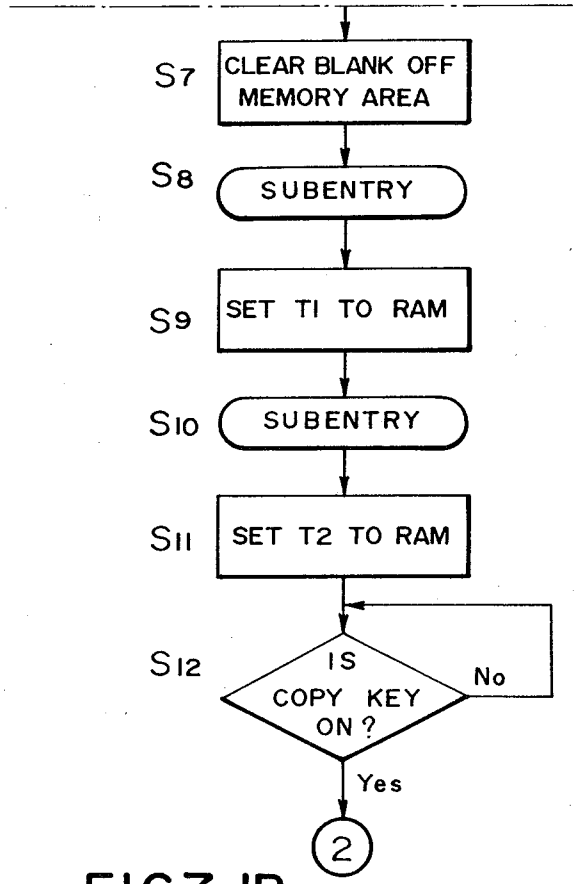
Figures 1A, 7:
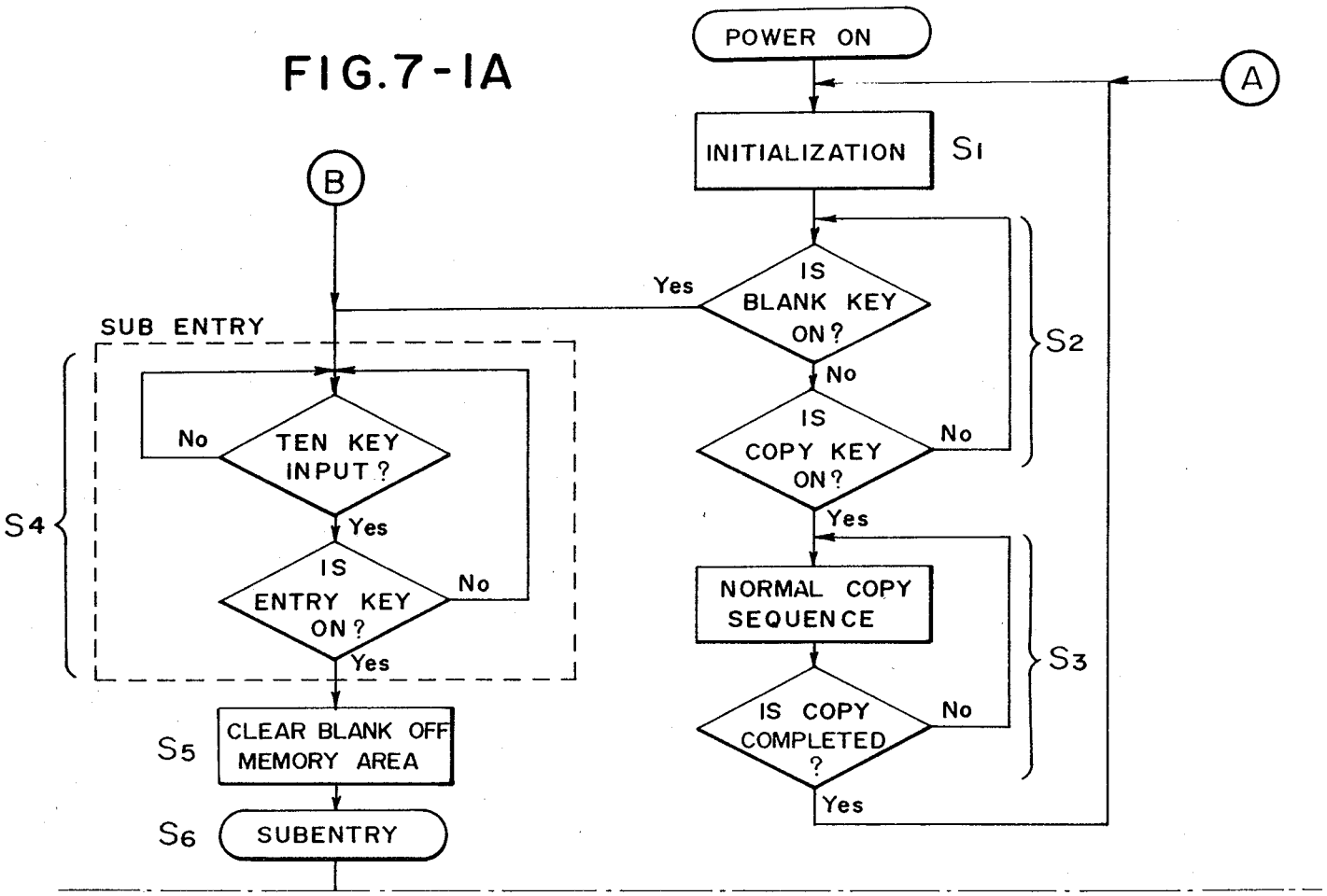
Figures 2, 2A, 7:
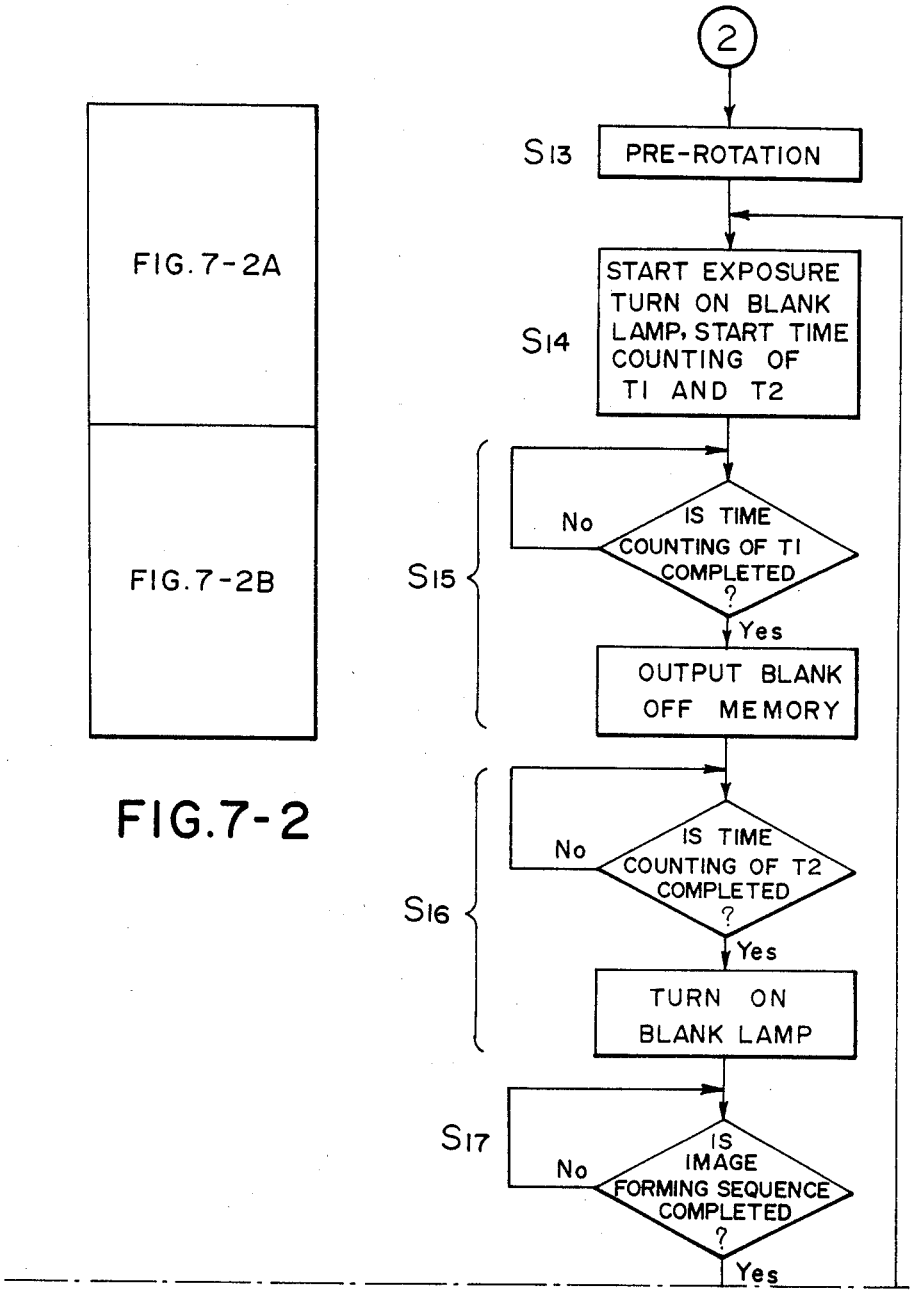
Figures 2B, 7:
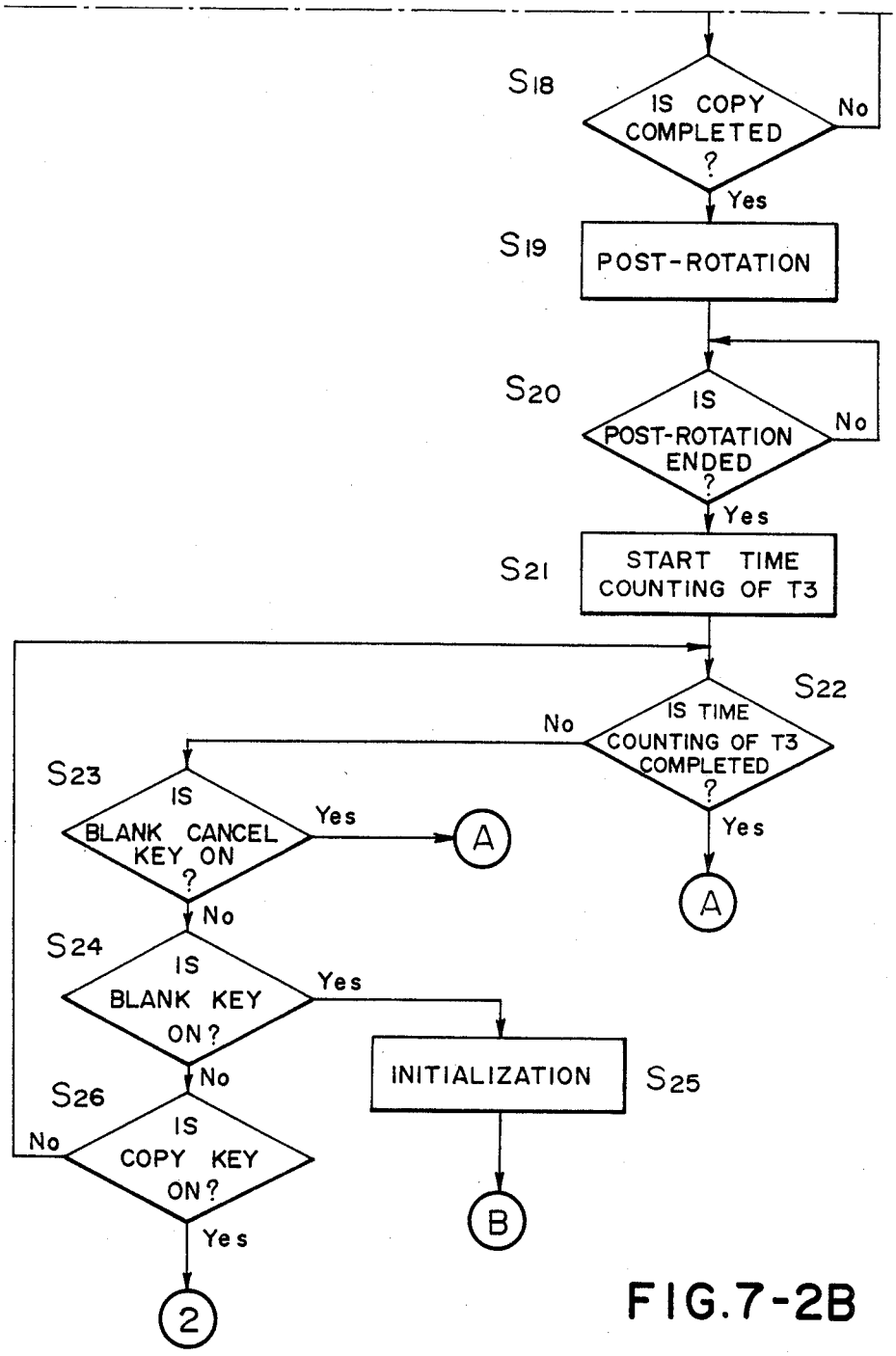

Line 7, "FIGS. 7-1B" should be --FIG. 7-1B--.

COLUMN 3

Line 8, "selectively the" should be --selectively, the--.

COLUMN 4

Line 50, "scaning" should be --scanning--.

COLUMN 6

Line 33, "of FIG. 5" should be --of the FIG. 5--.
Line 62, "wait the" should be --wait for the--.

UNITED STATES PATENT AND TRADEMARK OFFICE

CERTIFICATE OF CORRECTION

PATENT NO. : 4,582,417

DATED : April 15, 1986

INVENTOR(S) : TOSHIAKI YAGASAKI, ET AL.

It is certified that error appears in the above-identified patent and that said Letters Patent is hereby corrected as shown below:

COLUMN 8

Lines 18-19, "copy 40" should be --copy key 40--.
Line 30, " 2 repeated" should be -- 2 is repeated--.
Line 37, "works." should be --work.--.

COLUMN 9

Line 27, "one" should be --on--.

Signed and Sealed this

Third Day of February, 1987

*Attest:*

DONALD J. QUIGG

*Attesting Officer*

*Commissioner of Patents and Trademarks*